US009982964B1

(12) United States Patent
Beard et al.

(10) Patent No.: US 9,982,964 B1
(45) Date of Patent: May 29, 2018

(54) HOLSTER FOR A HANDGUN

(71) Applicant: N82 Tactical, Inc., Lexington, NC (US)

(72) Inventors: Nathan Beard, Lexington, NC (US); Nathan B. Johnson, Lexington, NC (US)

(73) Assignee: N82 Tactical, Inc., Lexington, NC (US)

( * ) Notice: Subject to any disclaimer, the term of this patent is extended or adjusted under 35 U.S.C. 154(b) by 2 days.

(21) Appl. No.: 15/195,102

(22) Filed: Jun. 28, 2016

Related U.S. Application Data

(63) Continuation-in-part of application No. 13/552,129, filed on Jul. 18, 2012, now Pat. No. 9,404,710.

(60) Provisional application No. 61/510,616, filed on Jul. 22, 2011.

(51) Int. Cl.
*F41C 33/02* (2006.01)
*F41C 33/04* (2006.01)

(52) U.S. Cl.
CPC ..... *F41C 33/048* (2013.01); *F41C 33/041* (2013.01)

(58) Field of Classification Search
CPC ..... Y10S 224/911; Y10S 224/912; Y10S 224/904; Y10S 224/907; F41C 33/0209; F41C 33/048; F41C 33/0263
USPC ..... 224/192–193, 587, 242, 243, 911, 912, 224/666, 667
See application file for complete search history.

(56) References Cited

U.S. PATENT DOCUMENTS

| | | | | |
|---|---|---|---|---|
| 2,576,231 | A | 11/1951 | Lawson, Jr. et al. | 224/2 |
| 3,289,903 | A * | 12/1966 | Taormina | F41C 33/0209 224/244 |
| 3,583,612 | A | 6/1971 | Theodore | 224/2 |
| 3,731,858 | A | 5/1973 | Baker | 224/2 |
| 3,942,692 | A | 3/1976 | Chia | 224/2 |
| 4,022,361 | A | 5/1977 | Devlin | 224/2 |
| 4,062,481 | A | 12/1977 | Clark | 224/2 |
| 4,667,374 | A | 5/1987 | Bianchi | 24/3 |
| 4,718,585 | A | 1/1988 | Atkins, Sr. | 224/238 |
| 4,785,983 | A | 11/1988 | DeSantis | 224/206 |
| 5,054,671 | A | 10/1991 | Else | 224/192 |
| D335,221 | S | 5/1993 | Nichols | D3/101 |
| 5,265,781 | A | 11/1993 | Nichols | 224/198 |
| 5,419,474 | A | 5/1995 | Marx | 224/244 |
| 5,445,303 | A | 8/1995 | Cawile, Jr. | 224/222 |
| 5,570,827 | A | 11/1996 | Wiesner | 224/587 |
| 5,816,459 | A | 10/1998 | Armistead | 224/246 |
| 6,050,465 | A | 4/2000 | Nelson et al. | 224/243 |
| 6,089,432 | A | 7/2000 | Gage et al. | 224/587 |
| 6,092,703 | A | 7/2000 | Johnson | 224/198 |
| 6,264,079 | B1 | 7/2001 | Skaggs | 224/193 |
| 6,398,089 | B1 | 6/2002 | Har-Shen | 224/192 |
| 6,685,066 | B2 | 3/2004 | Cragg | 224/192 |
| 6,814,270 | B2 | 11/2004 | Mason | 224/587 |
| 6,892,914 | B2 * | 5/2005 | Girbert | A45F 3/14 224/625 |
| 7,258,259 | B1 * | 8/2007 | Owens | A45F 5/02 224/192 |
| 7,314,152 | B1 | 1/2008 | Garrett | 224/192 |

(Continued)

*Primary Examiner* — Adam Waggenspack
(74) *Attorney, Agent, or Firm* — MacCord Mason PLLC

(57) ABSTRACT

A holster for carrying a handgun inside a wearer's beltline. In one embodiment, the holster includes a body-interface-surface (BIS) having a body-side (BS) and a gun-side (GS). A rigid mold is interfaced with the BIS. In another embodiment, the BIS may include a gun-lock region. A clip may be interfaced with the rigid mold. Other embodiments include methods of making and using a holster.

17 Claims, 13 Drawing Sheets

(56) References Cited

U.S. PATENT DOCUMENTS

| | | | | |
|---|---|---|---|---|
| 7,461,765 | B2 * | 12/2008 | French | F41C 33/0227 224/238 |
| D589,251 | S | 3/2009 | Har Shen | D3/222 |
| D601,339 | S | 10/2009 | Zusman | D8/222 |
| D603,159 | S | 11/2009 | Zusman | D3/222 |
| D620,705 | S | 8/2010 | Beard et al. | D3/222 |
| 8,074,850 | B2 | 12/2011 | Soderquist et al. | 224/243 |
| D681,943 | S | 5/2013 | Beard et al. | D3/222 |
| 2005/0127121 | A1 | 6/2005 | Wells | 224/193 |
| 2005/0279789 | A1 * | 12/2005 | Lowe | F41C 33/0209 224/244 |
| 2006/0219743 | A1 * | 10/2006 | Gallagher | A45F 5/02 224/192 |
| 2007/0181620 | A1 * | 8/2007 | Carver, III | A44C 9/0053 224/217 |
| 2010/0181353 | A1 * | 7/2010 | Craighead | F41C 33/0236 224/193 |
| 2010/0243690 | A1 * | 9/2010 | Lerch | A45F 5/02 224/198 |
| 2010/0270349 | A1 | 10/2010 | Craighead | 224/587 |

* cited by examiner

HOLSTER FOR A HANDGUN

This application is a Continuation of application Ser. No. 13/552,129 which claims the benefit of Provisional Application Ser. No. 61/510,616 filed Jul. 22, 2011.

BACKGROUND

(1) Field

The inventions of the present disclosure relate generally to handgun holsters and, more particularly, to holsters designed to carry a handgun inside the waistline.

(2) Related Art

Holsters for handguns are known in the art. Most commonly they are designed for carrying handguns externally, e.g., as seen in FIG. 1. In many situations, however, external carry is not ideal. For example, for those wishing to be discrete, for concealed carry, for backup carry, for off-duty police officers, for intelligence organizations, for military Special Forces, etc., it may be desirable to carry the handgun inside the waistline. Holsters for securely carrying handguns inside the waistband present challenges often not present with external carry holsters.

Others have attempted to develop carrying systems for carrying handguns inside the waistline with little success. Applicants have successfully developed holsters for comfortably and securely carrying handguns inside the waistline (see e.g. commonly owned U.S. patent application Ser. No. 12/946,405, the entire contents of which are hereby incorporated by reference). Despite the many benefits of Applicants' related technology, re-holstering often requires the removal of the holster and two-handed interface of handgun to holster.

Thus, there remains a need for a new and improved holster for a handgun which includes the benefits of Applicants' related technology while, at the same time, provides easier and more secure re-holstering.

SUMMARY

The inventions of the present disclosure are directed to, inter alia, holsters, holstering methods and methods of making holsters. In one embodiment, the holster includes a body-interface-surface (BIS) having a body-side (BS) and a handgun-side (GS). A rigid mold is interfaced with the BIS. A gun-lock region is configured that may move toward the channel of the rigid mold, may allow compression of the BIS and/or may be sufficiently rigid as to develop a positive retention of the handgun in the holster, when the holster is positioned on a wearer's beltline. A clip may additionally be interfaced with the rigid mold.

In another embodiment, a method of forming a holster comprises sandwiching at least three layers together to form a BIS, facing one side of the BIS toward a body-side (BS), facing one side of the BIS toward a gun-side (GS), including a compression layer, attaching a rigid mold, and creating a positive gun-retention channel between the ridged mold and the BIS. A clip may be attached to the rigid mold.

Accordingly, one aspect of the inventions of the present disclosure is to provide a holster for carrying a handgun inside a wearer's beltline, the holster including (a) a body-interface-surface (BIS) having a body-side (BS) and a gun-side (GS), wherein the BIS has a flexibility sufficient to mold to the wearer's body, and wherein the BIS has a surface area larger than the side profile of the handgun; and (b) a rigid mold defining a channel for receiving the handgun, the rigid mold interfaced with the GS of the BIS forming a gun-lock region.

Another aspect of the inventions of the present disclosure is to provide a holster for carrying a handgun inside a wearer's beltline, the holster including (a) a body-interface-surface (BIS) having a body-side (BS), a gun-side (GS), and a compression layer, wherein the BIS has a flexibility sufficient to mold to the wearer's body and wherein the BIS has a surface area larger than the side profile of the handgun; and (b) a rigid mold defining a channel for receiving the handgun, the rigid mold interfaced with the GS of the BIS forming a gun-lock region.

Still another aspect of the inventions of the present disclosure is to provide a holster for carrying a handgun inside a wearer's beltline, the holster including (a) a body-interface-surface (BIS) having a body-side (BS), a gun-side (GS), and a compression layer, wherein the BIS has a flexibility sufficient to mold to the wearer's body and wherein the BIS has a surface area larger than the side profile of the handgun; (b) a rigid mold defining a channel for receiving the handgun, the rigid mold interfaced with the GS of the BIS forming a gun-lock region; and (c) a clip interfaced with the rigid mold.

The above summary is intended to summarize certain embodiments of the disclosed inventions. Embodiments will be set forth in more detail in the figures and detailed description below. It will be apparent, however, that the detailed description is not intended to limit the disclosed inventions, the scope of which should be properly determined by the appended claims.

DESCRIPTION OF THE PREFERRED EMBODIMENTS

Figure 1:
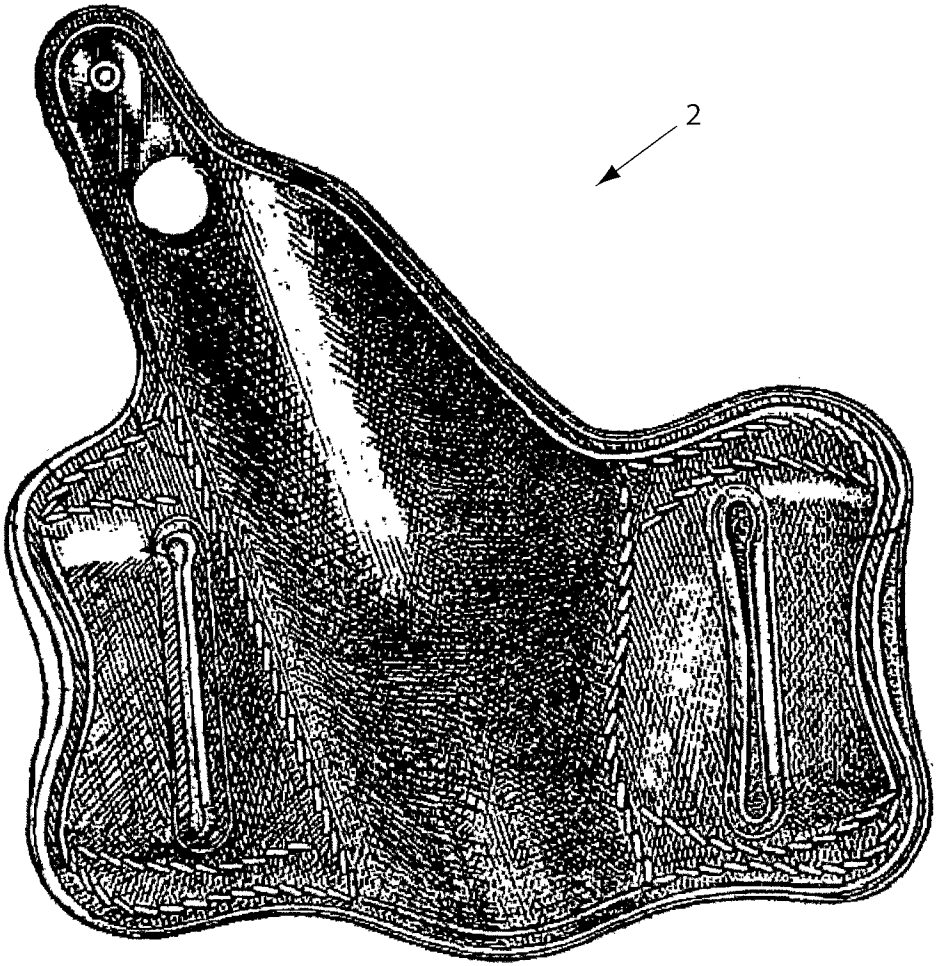
FIG. 1 shows an external prior art handgun holster.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
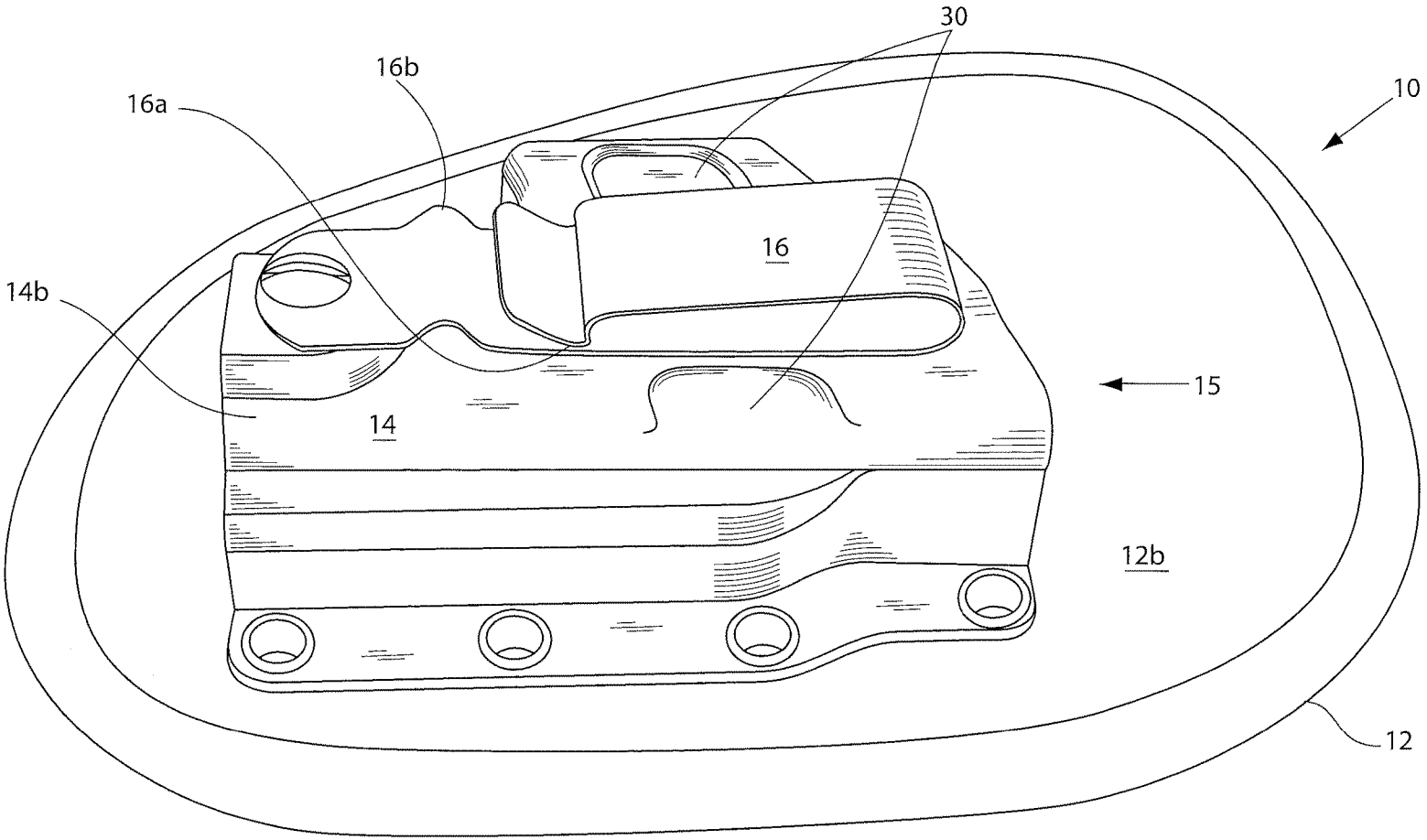
FIG. 2 shows a perspective view of one embodiment of a handgun holster constructed according to the present disclosure.
Figure 3:
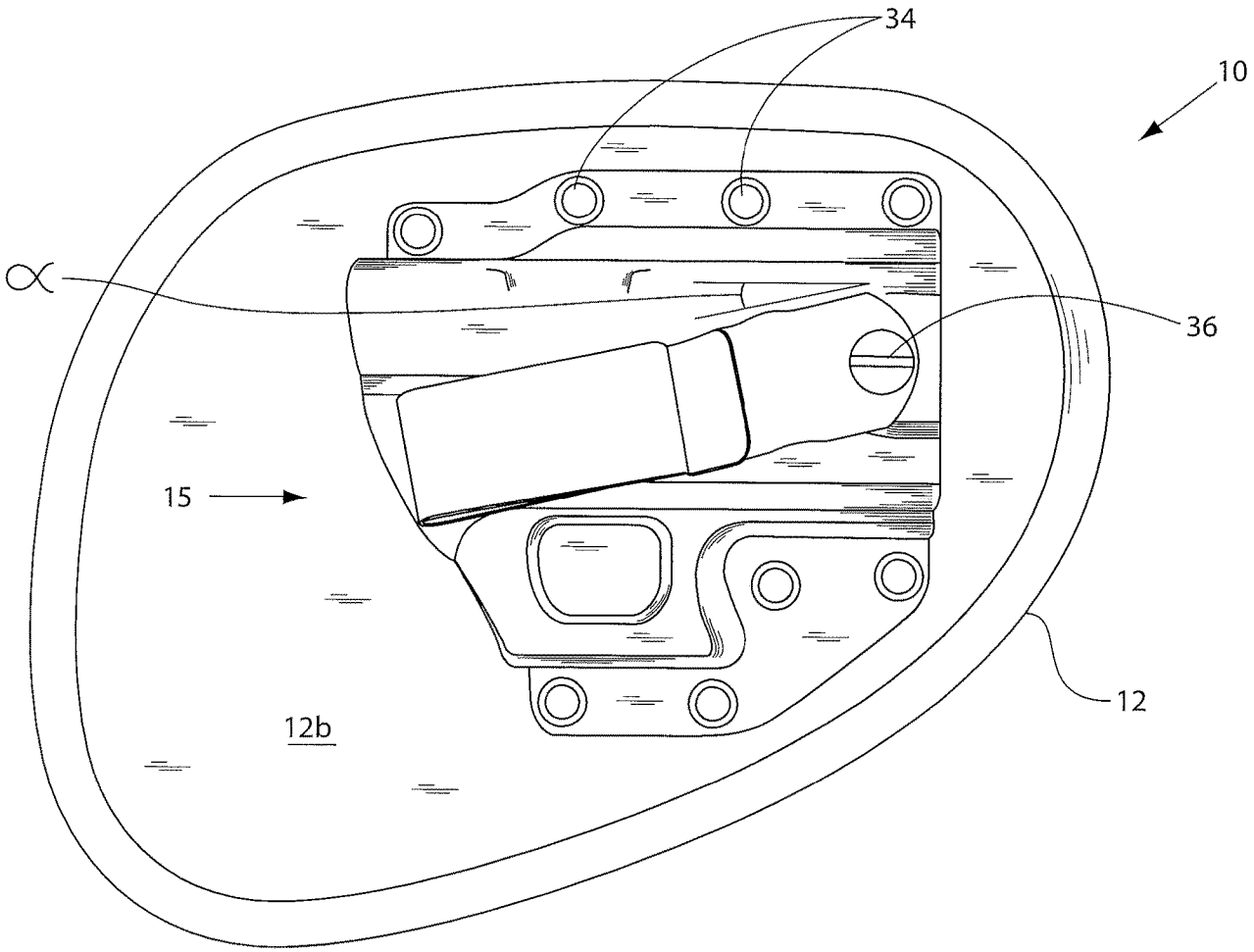
FIG. 3 shows a side view of one embodiment of the holster shown in FIG. 2.
Figure 4:
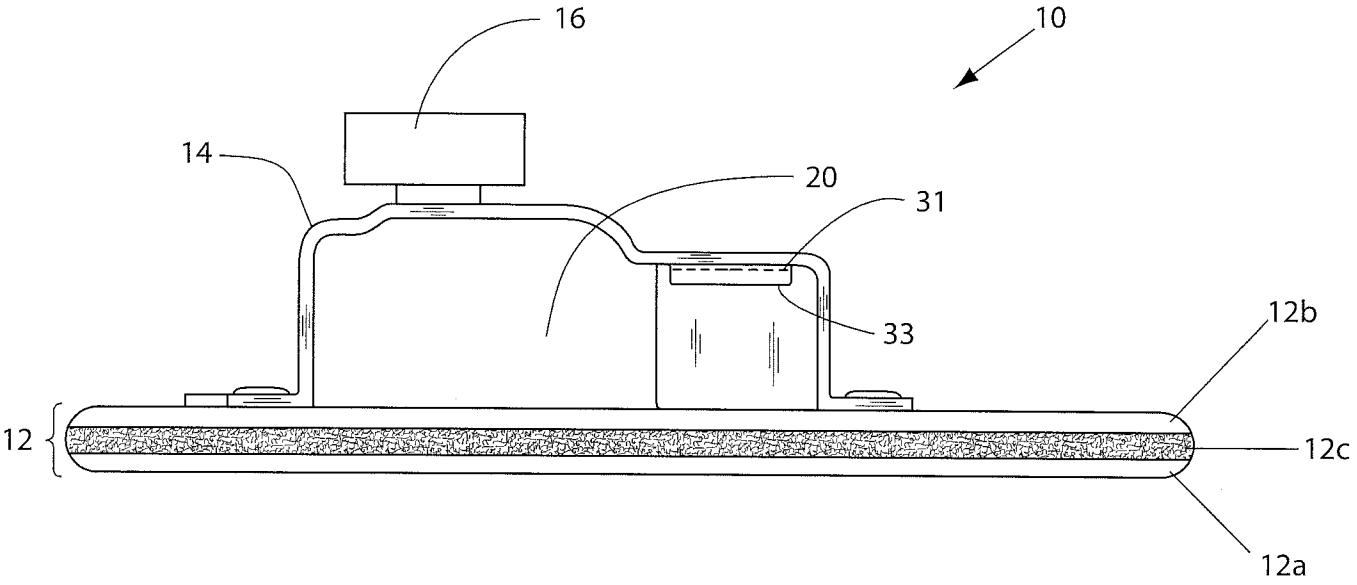
FIG. 4 shows a top view of one embodiment of the holster shown in FIG. 2 with a cut away view of the BIS.

Referring now to the drawings in general and FIGS. 2-4 in particular, it will be understood that the illustrations are for the purpose of describing preferred embodiments of the disclosure and are not intended to limit the inventions thereto. As seen in FIG. 2, a holster for a handgun, generally designated 10, is shown constructed according to the present disclosure. Holster 10 includes a body-interface-surface (BIS) 12 and a rigid mold 14. Holster 10 may further include a clip 16 interfaced with the rigid mold 14.

BISs may vary from embodiment to embodiment, but typically include at least a body-side (BS) 12*a* (see e.g. FIG. 4) and a gun-side (GS) 12*b*. The BS 12*a* and the GS 12*b* may be considered as layers. BSs are configured to face the wearer's body, while GSs are configured to face the handgun.

Figure 5:
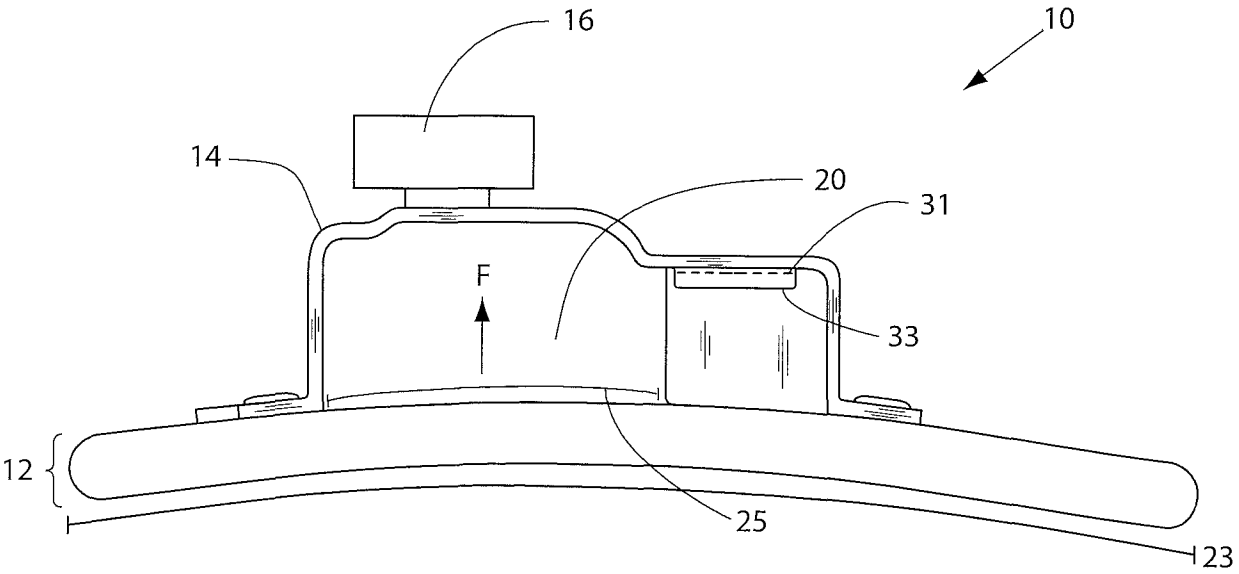
FIG. 5 shows another top view of one embodiment of the holster shown in FIG. 2.

BISs may be rigid and/or non-rigid and may have a flexibility sufficient to mold to the wearer's body. The BIS, including a body-side layer and a gun-side layer, may mold around the hip, the rear of the hip, the front of the hip, the small of the back, the front of the waist, etc. A variety of materials may have sufficient flexibility to achieve the desired mold. The BIS may have a first substantially linear position, as seen in FIG. 4, and a second molded position, as seen in FIG. 5. The BIS may include outer peripheral edges 12, 12'. The BIS may have a flexibility sufficient, in the second molded position, to mold the outer peripheral edges inward toward one another, forming a concave curvature 23. The concave curvature may be a substantially smooth and continuous curvature from one edge of the BIS to the other, as seen in one example in FIG. 5. The curvature 23 may be rigid enough to be molded to substantially maintain the curvature in the holster even when not being worn by the wearer.

BISs may have a surface area larger than the side profile of the holstered handgun 15 (the function of the surface area is further discussed below). The BIS may include a lower part and an upper part, the upper part generally referring to the part of the BIS above the interface with a rigid mold and the lower part generally referring to the part of the BIS below the interface with a rigid mold. The BIS may have an extended upper part configured to extend upward further than the lower part extends downward. The extended part may extend to a height H such that a portion of the holster forms a barrier between the user and the entirety of a holstered handgun, including the grip of a holstered gun. The extended upper part may include a transverse projection 17 forming a portion of the barrier between the grip of a holstered handgun and the user. The upper portion of the BIS may have a width W that exceeds the width of the lower portion. The transverse portion, in some examples, may give an asymmetrical oblong shape to the BIS.

BISs may also include a compression layer 12*c*. The BIS in some examples include a BS-layer 12*a*, a GS-layer 12*b*, and a compression layer 12*c* positioned between BS-layer and GS-layer (see e.g. FIG. 4). In typical embodiments, BS-layers have a thickness of about 0.5 to about 3.0 mm, more typically about 1.2 mm GS-layers have a thickness of about 0.5 to about 3.0 mm, more typically about 1.4 mm. Compression layers have a thickness of about 0.5 to about 3.0 mm, more typically about 2 mm. Thickness of the layers, and overall thickness of the BIS contributes to the ability of the current holster to both mold to the wearer's body and to allow for carrying inside the waist band. If the BIS becomes too thick, with its multiple layers collectively, then it may become resistant to molding, for example, too rigid to mold to the wearer's body and/or may become too thick for insertion inside the waist band of wearer, preventing successful and comfortable concealed carry. Applicant also realized that if the BIS is too thin, it may not have a flexibility sufficient to mold and/or maintain a mold and/or may not mold to a second molded position, and/or it may not be supportive enough to contribute to securing the handgun in the gun-lock region.

Typically, the BS-layer includes leather, more typically, leather having a suede finish. Applicants have discovered that in the particular examples and configuration of construction of holsters of the inventions, the coefficient of friction of suede against the body, e.g., a wearer's skin or clothing is sufficient to greatly contribute to the overall stability of the platform. Materials having similar coefficients of friction are also considered suitable. The BS-layer may cover the complete BS-side to any selvedge, creating a smooth uniform surface layer. Typically, the GS-layer includes leather, but other materials may also be suitable.

In most embodiments, the GS of the BIS is substantially, e.g., greater than 50%, or entirely, e.g., greater than 90%, formed by the GS-layer. Somewhat similarly, in most embodiments, the BS of the BIS is substantially, e.g., greater than 50%, or entirely, e.g., greater than 90%, formed by the BS-layer.

In many embodiments, compression layer 20 is formed from neoprene, e.g., about 2 mm thick and backed on each side with nylon. Varying from embodiment to embodiment, compression layers typically have a surface area of at least 60%, at least 65%, at least 70%, at least 75%, at least 80%, at least 85%, at least 90%, at least 95% and at least 99% of the side profile of the handgun. Somewhat similarly, compression layers may have a surface area of at least 60%, at least 65%, at least 70%, at least 75%, at least 80%, at least 85%, at least 90%, at least 95% and at least 99% of the BS-layer. Even more typically, compression layers will cover the complete BIS, e.g. to the selvedge, creating a smooth uniform layer.

Compression layers typically provide at least a couple of functions. For example, they cushion the user from the handgun to allow for comfortable carrying. Additionally, they may allow the handgun's shape to define a compression with the BIS, thereby increasing the holster's purchase on the handgun and stability while being carried. In other examples, the compression layer allows the BIS, which is otherwise contributing to retention of the handgun in the holster, to give enough for a holstered handgun to be released in response to a twist-release by the user.

Materials used in construction of the BIS may vary from embodiment to embodiment, so long as desired function is maintained.

As seen in FIG. 2, holsters also include a rigid mold, e.g., mold 14. Mold 14 is typically interfaced with the GS of the BIS, e.g. with side flanges for mounting. The mold 14 may mount to the GS of the BIS with attachment points extending through the GS and into the BIS. The attachment points may terminate inside the BIS to secure the mold 14 such that the attachment points do not extend through the BS 12*a* and the BS 12*a* maintains a solid soft surface against the wearer, without any attachment hardware for the mold extending through. Rigid molds typically have a height 14H sufficient to cover at least one of ¼, ⅓ or ½ or more of the height of the side profile of the handgun. As shown, rigid mold 14 includes an outside surface 14*b* having a rigidity sufficient to maintain its own shape when a handgun is not contained in the channel, e.g. the shape of a partial handgun. A variety of materials, e.g. polymers, may be used to create a mold having the sufficient rigidity. By way of example, a polycarbonate may be used for making the mold 14. The rigid mold defines, at least in part a channel 20 (see e.g. FIG. 4).

In this example, channel 20 is defined at its outside surface by rigid mold 14 and at its inside surface by the flexible GS layer 12*b*. In other examples, channels may be formed at their inside surface by other materials, e.g., polymers having more or less flexibility than the rigid mold 14. Accordingly, in some examples, the rigid mold will not include an inner surface, e.g., it will be substantially arch shaped as illustrated in FIG. 4 or may further include a liner.

As illustrated primarily in FIGS. 5, 6, 7, 7A and 7B, holster 10, may also include a gun-lock region. The gun-lock region may include/be defined by the BIS or a portion of the BIS (for example, the GS), the channel 20 and/or the rigid mold 14. The gun-lock region may be configured so that the GS of the BIS moves toward the channel 20 of the rigid mold when the holster is positioned on a wearer's beltline. In some examples, the gun-lock region is defined by a substantially rigid mold on one side and the BIS on the second side, the BIS interfaced with the rigid mold on a left side and on a right side. The channel portion of the BIS 25 spanning from the right side interface to the left side interface is movable between a first non-biased position when not worn by a user and a second biased position when worn by a user. The channel portion 25 may be a cupped shaped structure with a curvature inward toward the channel. When the holster is worn by the user a force F may be accepted by the channel portion 25 that maintains the BIS in the inward, toward the channel 20, curved position, such that, the channel portion supplies one part of a two part gun-lock mechanism in the gun-lock region.

In many examples, the movement toward channel 20 of the GS generates a force F sufficient to retain the handgun when the holster is positioned on a wearer's beltline (as placing the holster on the body generates a movement inward, and accommodated by the GS, sufficient to create the force) and, wherein the gun-lock region does not generate a force sufficient to retain the handgun when not on a wearer's beltline. The result is a system that allows for comfortable and secure carrying of a handgun. The handgun can be withdrawn with force by the user but will remain secured by, inter alia, the gun-lock region during carrying. When the holster is not being worn, the handgun is able to be withdrawn without a force by the user as the gun-lock region is not activated.

Alternatively, the gun-lock region may be formed not by movement toward channel 20 of the GS 12*b*, but may be defined by GS 12*b* opposing mold 14 in a manner to create positive retention of the handgun by securing the handgun firmly between the mold 14 and GS 12*b*. By way of example, the compression layer 12*c* may allow the GS 12*b* to compress toward the wearer, away from the channel 20, or the BIS may maintain a position in order to accommodate the handgun while maintaining the positive retention of the holster 10 when the handgun is placed into the channel 20.

Figure 7:
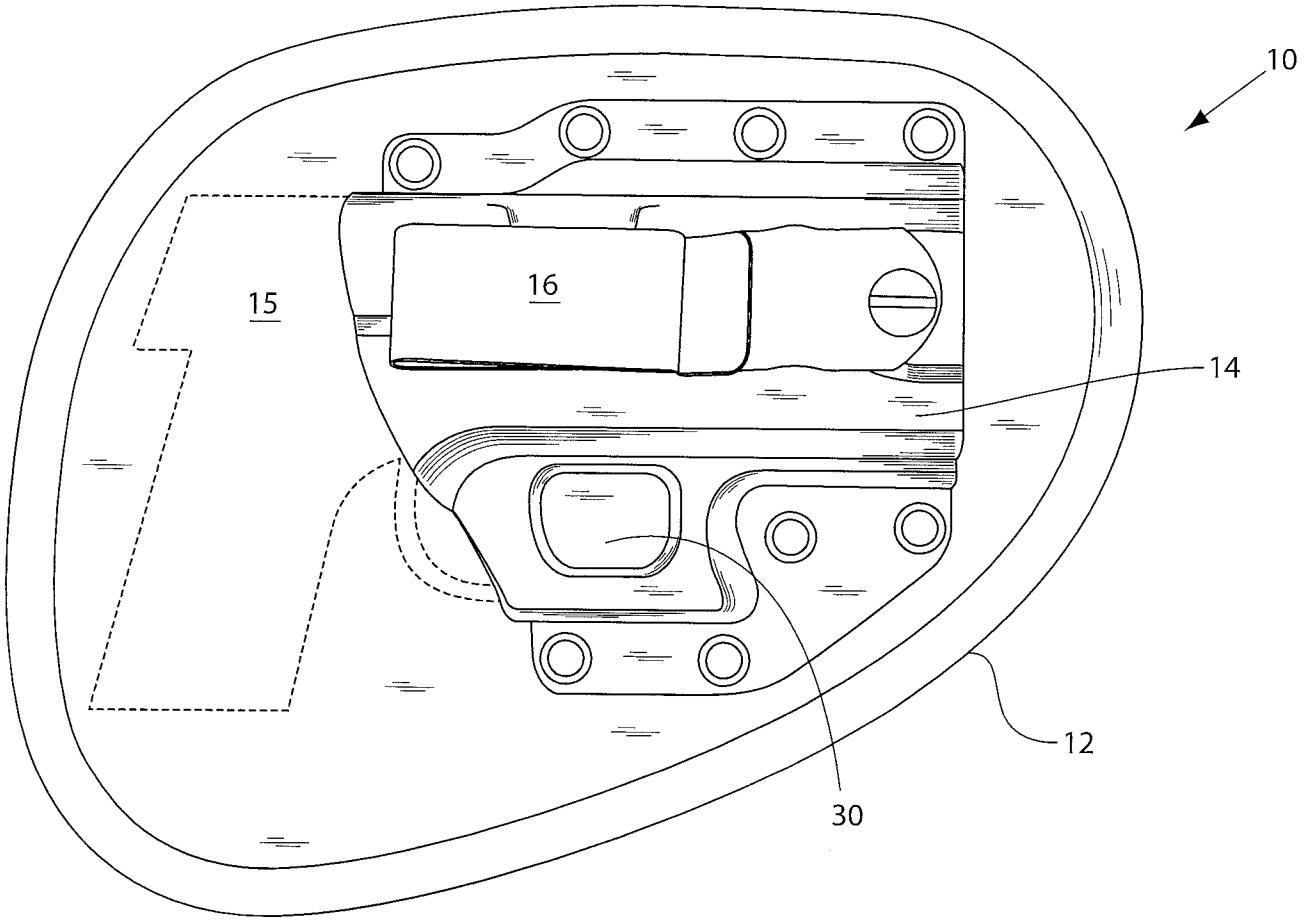
FIG. 7 shows a side view of one embodiment of the holster shown in FIG. 2 with a handgun holstered.
Figure 7A:
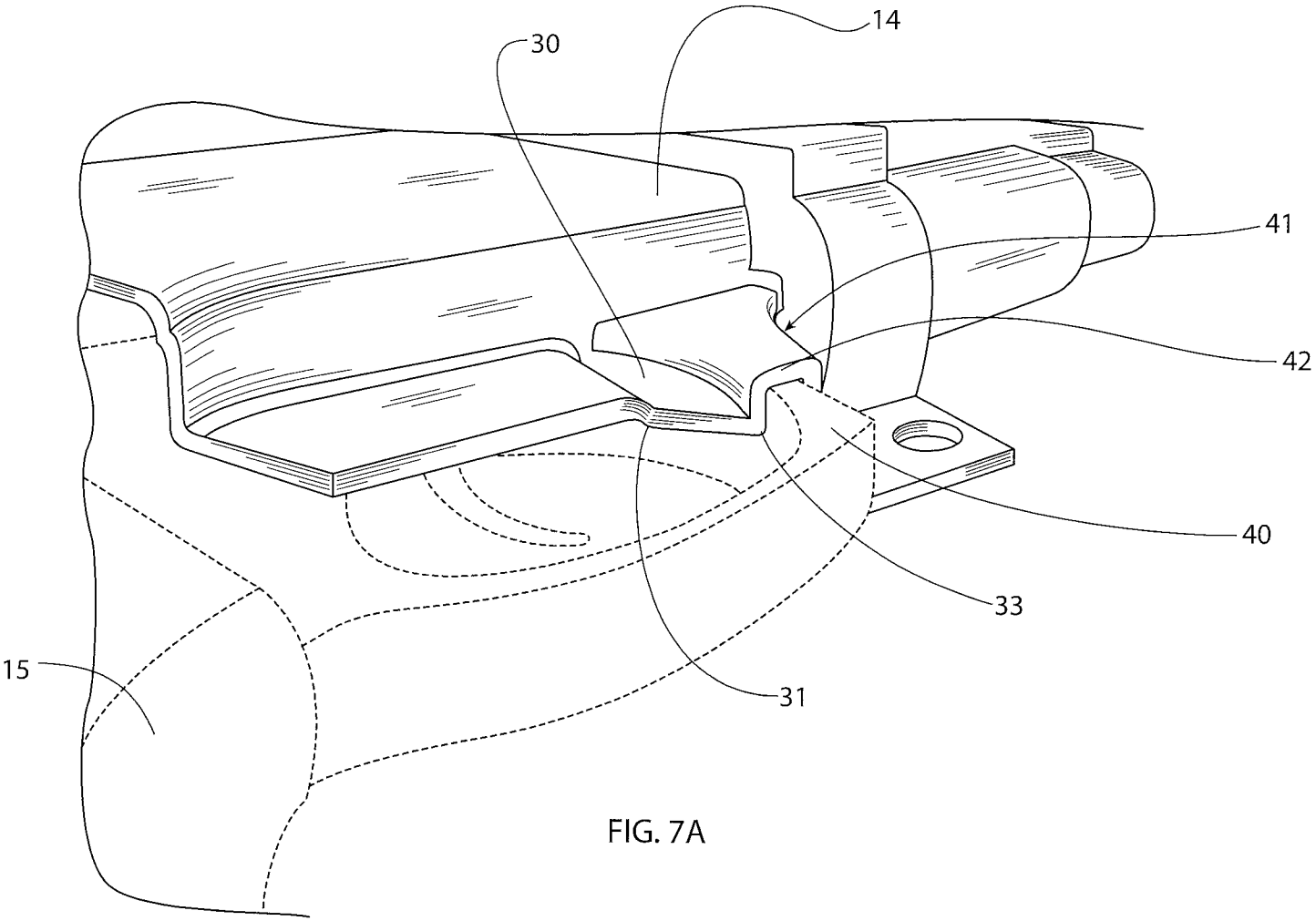
FIG. 7A shows a close up cut away view of the trigger area of the embodiment of the holster as shown in FIG. 7 with a handgun holstered.
Figure 8:
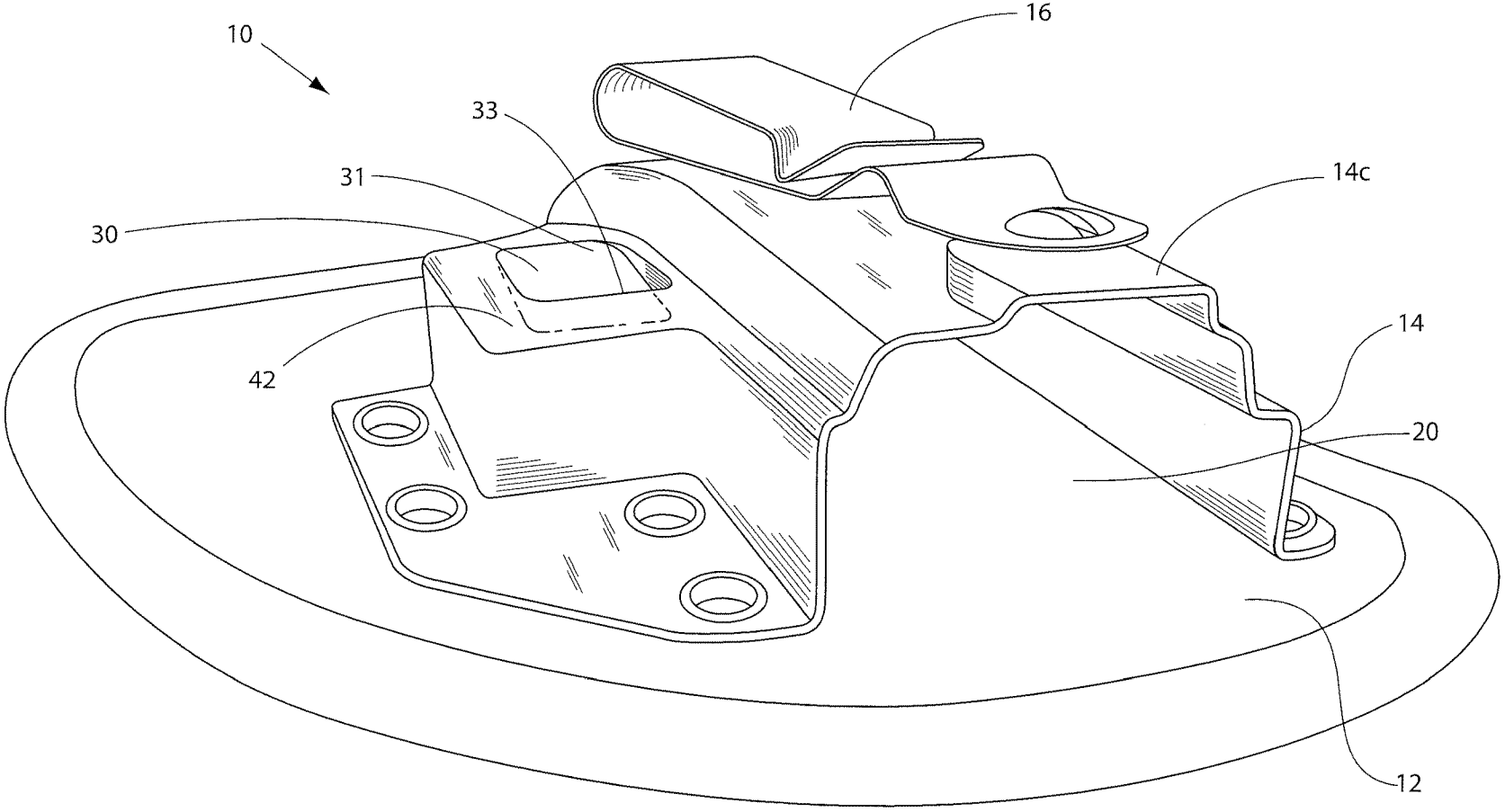
FIG. 8 shows a perspective bottom-side view of one embodiment of FIG. 7C.
Figure 9:
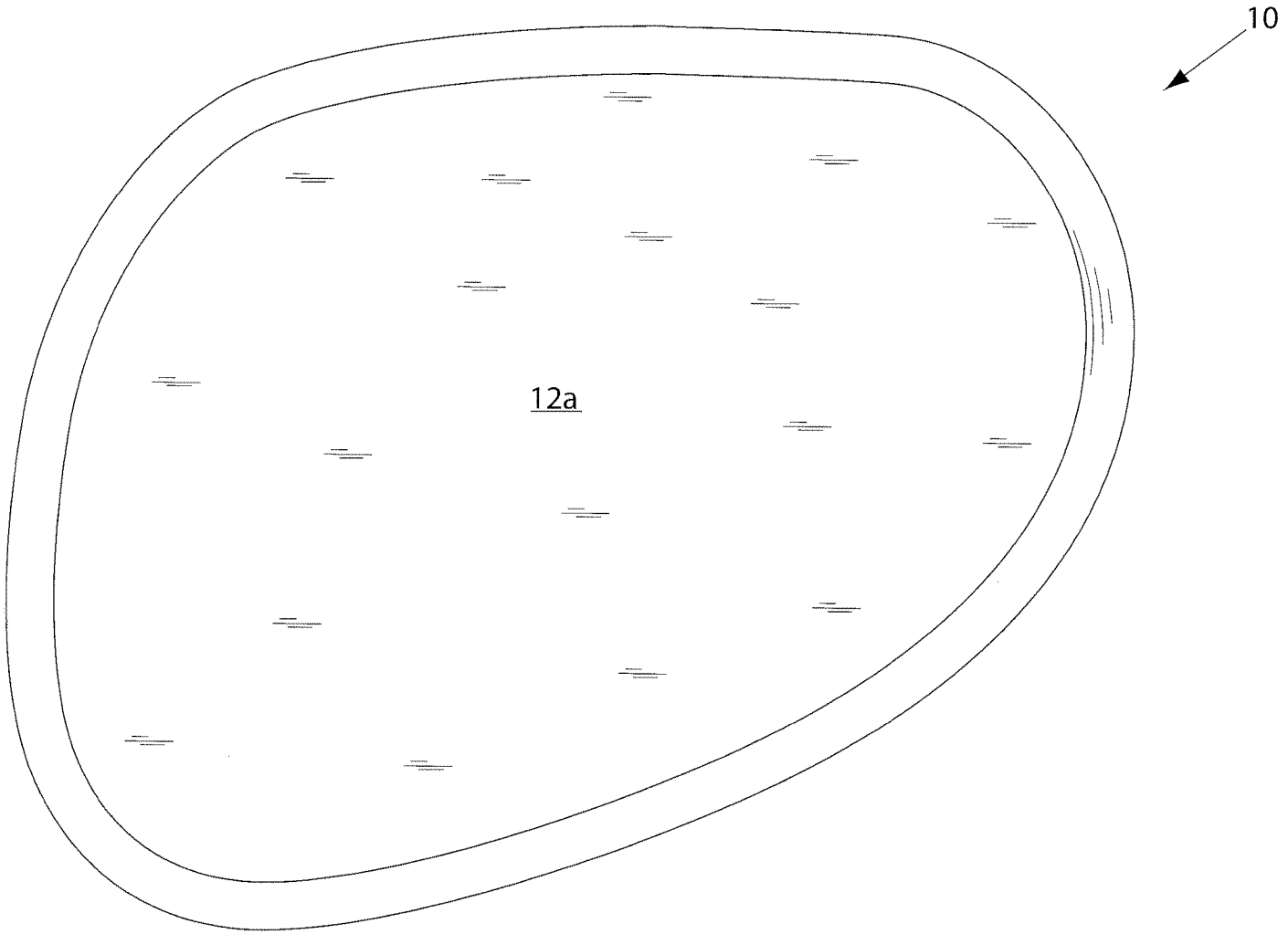
FIG. 9 shows a backside view of one embodiment of a handgun holster constructed according to the present disclosure.

In yet another embodiment, the mold 14 may include one or more retention structures 41 (see e.g. FIGS. 7A-8). The one or more retention structures 41 may take on various shapes or locations to accommodate the design of different caliber handguns, handgun body styles and/or handgun accessories, such as bumps, depressions and/or combinations of bumps and depressions. The one or more retention structures 41 typically are structured from depressions 30, so as to interface with depressions or projections on the handgun body, such as a trigger guard 40. The one or more retention structures 41 may interface with the handgun so as to lock the handgun in place within the channel 20. The mold 14 and the GS 12*b* may typically and collectively be rigid enough to securely hold the handgun within the holster 10, for example, when the holster is worn by the user.

Retention structures 41 correspond to depressions/protrusions 30 mimicking the contour of the body of the handgun. By way of example, a depression 30 may be structured so as to contour at least a portion of retention structure 41 to correspond to a trigger guard 40 on a handgun, as seen in FIG. 7A. Retention structure 41 may include a retention bump associated with a depression 30. In some examples, depression 30 may be a wedge shaped portion. Depression 30 may have a first portion end 31 that does not extend into channel 20 as far as a second portion end 33. The wedge shaped portion may be formed by a portion of depression 30 or include all of depression 30. By way of example, the depression 30 may be an integrally formed wedge shaped portion, forming the wedge by extending inwardly and progressively into the channel from first portion end 31 to second portion end 33. Second portion end 33 may adjoin a projection 42. Second portion 33 may turn outwardly from the channel 20 at about an 80 to 100 degree angle to form projection 42. Projection 42 may be formed to accept a trigger guard from a handgun once it is guided into the channel 20 past the wedge shaped portion. The wedge shaped depression 30 may form the second part of a two part gun-lock mechanism in the gun-lock region.

In operation, to unlock a secured handgun from the holster 10, a twisting motion allows the wearer to unlock and withdraw the handgun with one-handed operation. The wearer is able to grasp the handgun by placing their thumb between the holster and the grip and then slightly twisting the grip toward the wearer's body. The compression layer 12*c* may give enough toward the wearer's body and away from the channel 20, to allow the wearer a smooth draw from within the holster 10. In embodiments where the GS 12*b* is moving toward the channel 20, the twist may be enough to allow the wearer to release and retract the handgun from the holster.

Figure 7B:
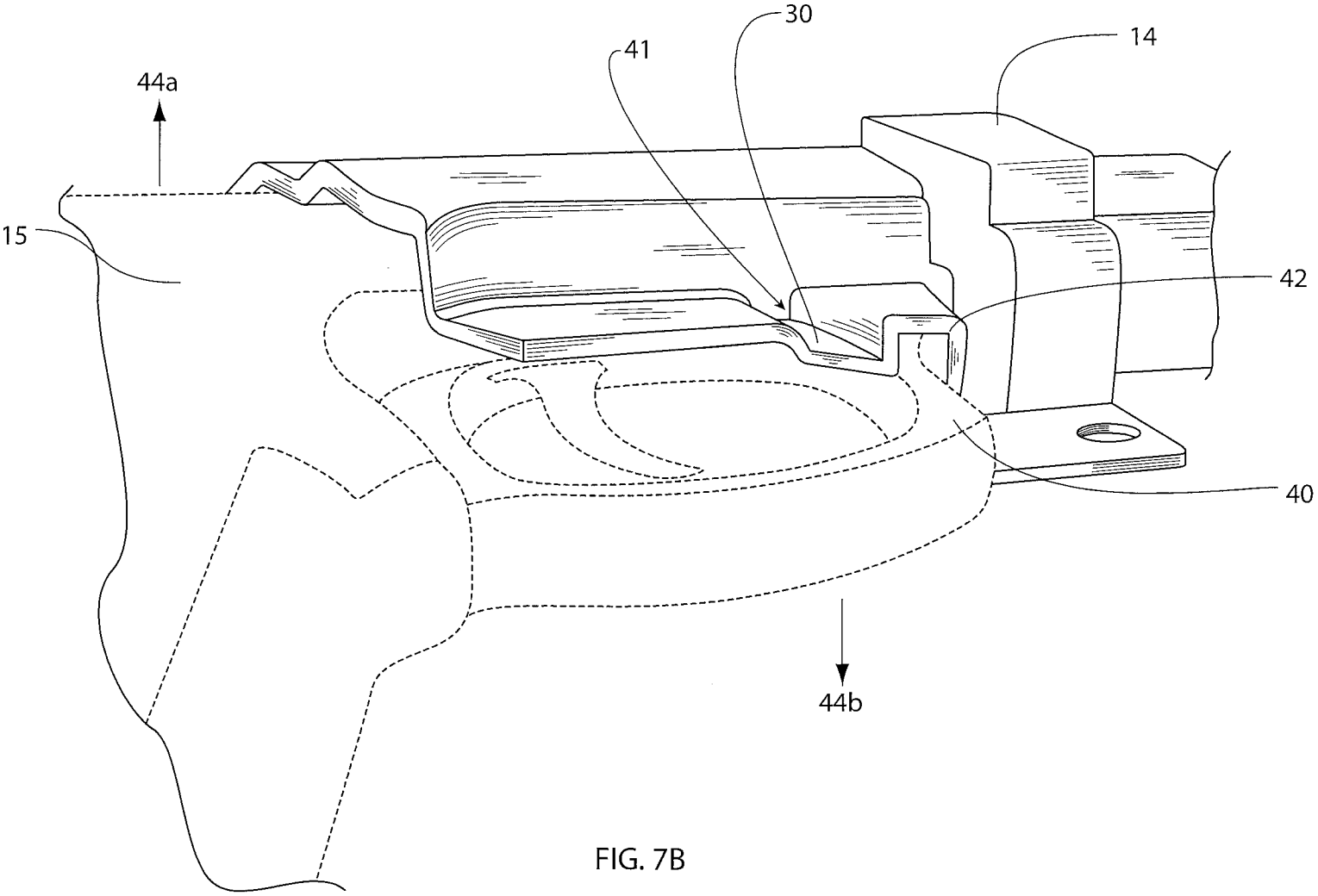
FIG. 7B shows a close up cut away view of the trigger area of the embodiment of the holster as shown in FIG. 7 as the handgun is manipulated for release from the holster.
Figure 7C:
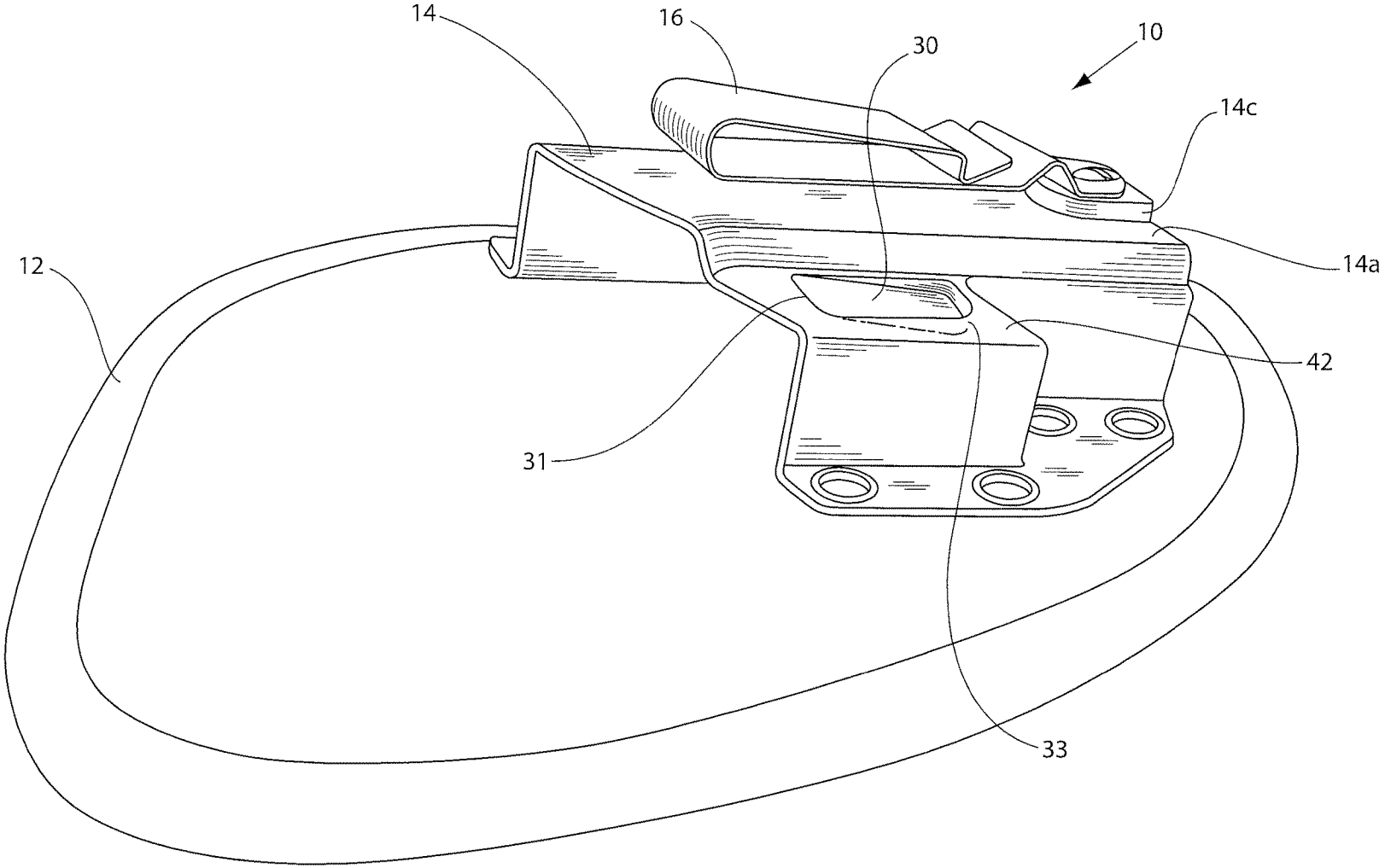
FIG. 7C shows a perspective top-side view of another embodiment of the disclosure.
Figure 7D:
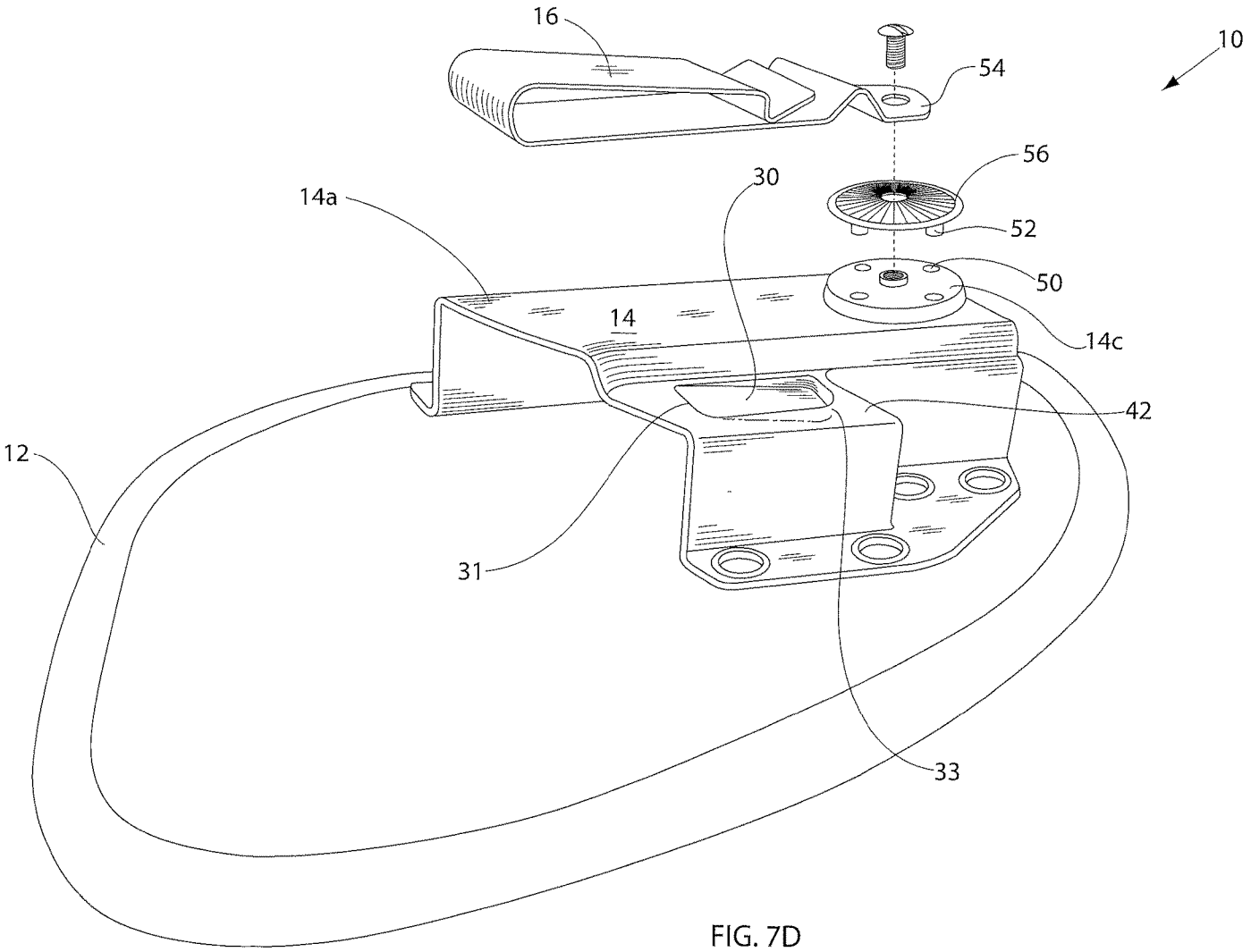
FIG. 7D shows an exploded view of one embodiment of a clip of the holster of FIG. 7.

In other embodiments, the wearer may twist the grip toward the body in order to release the trigger guard (see e.g. FIG. 7B, 44*a* and 44*b*) or other handgun part 40 from the retention structure 41. As best seen in FIG. 7A, the trigger guard 40, when being holstered, slides easily over first portion end 31 and the wedge shaped portion guides the trigger guard past the second portion end 33 and into a part of the retention structure 41 that accepts the trigger guard 40 to nestle into it, projection 42. The BIS compresses enough to allow the slight twisting of the handgun 44*a* (at the top portion of the handgun), 44*b* (at the lower, trigger end portion of the handgun) by the wearer and release of the trigger guard 40 as seen in FIG. 7B over the second portion end 33. By way of example, the force F of channel portion 25 and the wedge shaped depression 30 form a two-part locking mechanism that secures the handgun under a positive retention. By unlocking the handgun with the twisting motion such that the trigger guard slides upwards along the wedge shaped portion, the positive retention force is released, enabling the wearer a smooth draw. Therefore, the holster 10 allows the handgun to be holstered with one-handed operation, secures the handgun without the need for a strap and prevents accidental removal or the firearm, while still allowing twistable release and retraction of the handgun with one-handed operation.

Clip 16 is interfaced with the rigid mold, as seen for example in FIGS. 3, 7C, 7D and 8). Any clip having a size and rigidity suitable for affixing a holster as described herein inside of a wearer's pants may be sufficient. In some embodiments, the angle α of the clip's positioning may be adjusted to facilitate the carrying of the holster in different positions, typical a angles will be chosen from about 0 to about 30 degrees.

Figure 6:
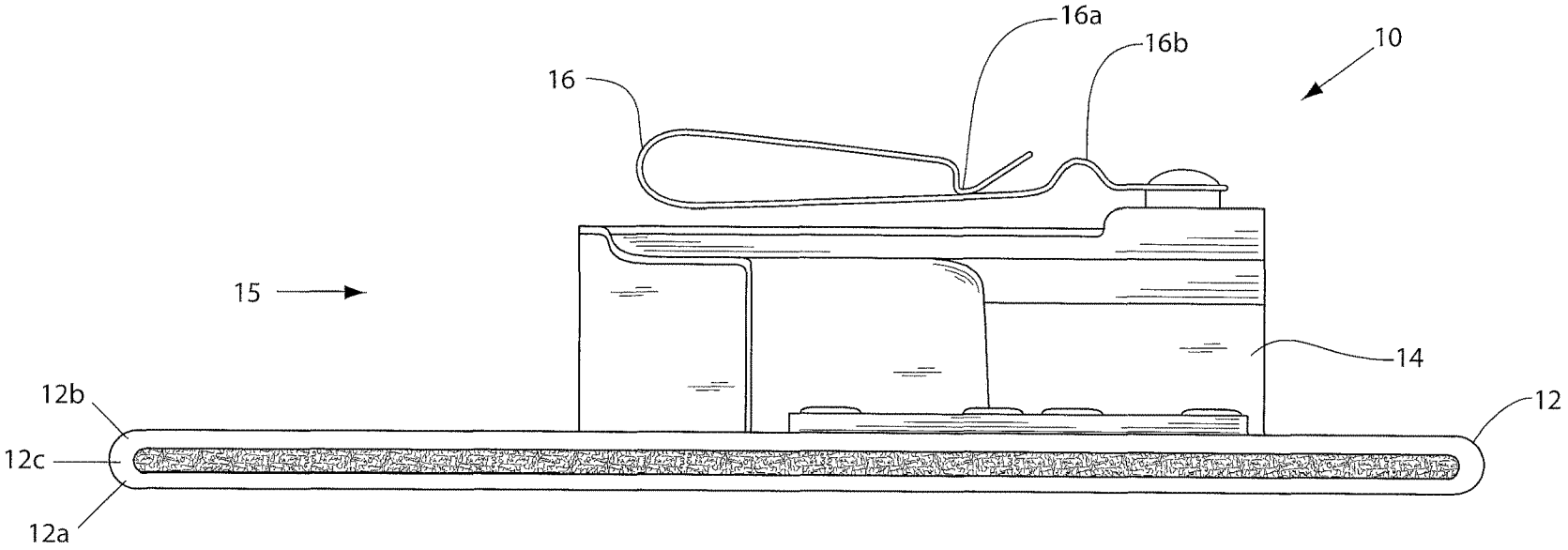
FIG. 6 shows a side view of one embodiment of the holster shown in FIG. 2 with a cut away view of the BIS.

In some embodiments, clip 16 may further include a clamp 16*a* (see e.g. FIG. 6). Clamp 16*a* assists in securing the clip to the wearer's waistline. Additionally, clip 16 may include a pressure point 16*b* in proximity to clamp 16*a*. Pressure point 16*b* serves to increase the effectiveness of clamp 16*a*, for example, by increasing the resistance at the waistline of the clip on the wear's clothing.

In some examples, the rigid mold may include at least a first plane 14*a* at the outside of the rigid mold 14. In some examples, the outside of the rigid mold may include a series of planes at progressively outward positions. At least one clip 16 may be located on a portion of the rigid mold that protrudes outwardly 14*c*, for example, from a first plane 14*a* at the outside of the rigid mold 14. The clip 16 may interface with the mold 14 at a second plane outwardly located from the first plane (FIGS. 4-7D).

The rigid mold 14 may include a first outside surface plane having an upper surface of the rigid mold being located toward the opening of the channel and a bottom surface of the rigid mold being located toward a distal end of the rigid mold away from the upper surface. At least one pivotally supported clip 16 may be attached on a portion of the rigid mold that protrudes outwardly 14*c* from the first outside surface plane. The portion may be located near the bottom surface of the rigid mold. The portion may remain in the bottom half in one example, and/or bottom third of the mold in other examples. The pivotally supported clip may pivot about an axis that passes perpendicularly through the mold and is substantially parallel to the outside surface of the rigid mold and the gun contact surface. The clip may pivot at an angle alpha chosen from about 0 to about 30 degrees to alternately position the holster at varying positions, in some embodiments even adjustable while worn. The varying positions may be between a straight drop and a cant. The clip may pivot bi-directionally along the axis.

In other embodiments, the clip may include a rotational assembly. The rotational assembly may allow the clip to pivot about an axis that passes perpendicularly through the mold and is substantially parallel to the outside surface of the rigid mold. The rotational assembly may include a clip attachment end 54 that may interface with an attachment part 56 that fits onto projection 14*c*. Attachment end 54 may be spaced apart from the projection 14*c* by attachment part 56. The attachment part 56 may include at least two stops that allow rotation of the clip about the axis from about 0 to at least 30 degrees. By way of example, the stops may be teeth or projections that allow the clip to be incrementally adjusted to different positions about the axis. The clip may be maintained at the different positions about the axis when the holster is in use. The stops may mate with corresponding stops on the underside of the clip attachment end 54. The rotational assembly may be secured, by way of example, with a rivet, screw, a bolt and/or a rod through the clip attachment end 54, the attachment part 56 and the projection 14*c*.

The above described holster allows for the secure and stable carrying of a handgun inside a wearer's waistline. It allows for surprisingly discrete, comfortable and stable carry due to the construction of the holster. Further, holsters of the inventions allow for improved access to a handgun because Applicants' holsters allow for handguns to be carried without the need for a latch or snap on the holster. Others will no doubt observe other advantages.

Inventions also include methods of forming a holster for carrying a handgun inside a wearer's beltline. In typical embodiments, a method comprises sandwiching at least three layers together to form a BIS; attaching an rigid mold to the BIS; and attaching a clip to the rigid mold. The at least three layers, the BIS, the rigid mold, and the clip can be any of those described above. Methods typically include attaching selvedge to the edge of the three layers, e.g., to secure the sandwich structure.

Numerous characteristics and advantages have been set forth in the foregoing description, together with details of structure and function. The disclosure, however, is illustrative only, and changes may be made in detail, especially in matters of shape, size and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety. It is further noted that, as used in this specification, the singular forms "a," "an," and "the" include plural referents unless expressly and unequivocally limited to one referent.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A handgun holster for carrying a handgun inside a wearer's beltline, said holster comprising:

(a) a body-interface-surface (BIS) having a body-side (BS) and a gun-side (GS), wherein the BIS has a surface area larger than the side profile of the handgun when holstered to form a barrier between the entirety of the holstered handgun and the wearer, the BIS having an upper portion and a lower portion, the BS having a moldable uniform surface to fit inside a wearer's beltline flush against the wearer;

(b) a rigid mold attached to the gun-side of the BIS at the lower portion and defining a channel for receiving the handgun, the rigid mold having an open non-linear top and an open linear bottom, an enclosed first side and an enclosed second side, the interface between the rigid mold and the GS of the BIS forming a gun-lock region;

(c) at least one pivotally supported clip, pivotal about an axis that passes perpendicularly through the mold, and the clip attached on a portion of the rigid mold that protrudes further outwardly from an outside surface plane of the rigid mold, the portion located near the bottom surface of the rigid mold and remaining in the bottom third of the mold; and (d) the gun-lock region including a two-part gun lock mechanism;

the first part of the gun-lock mechanism including a channel portion spanning from a right side interface between the BIS and the mold and a left side interface between the BIS and the mold in the lower portion, the channel portion being movable between a first non-biased position when the holster is not being worn and a second biased position when the holster is being worn by the user, the second biased position configured to secure the gun in the holster until acted upon by a user force when the holster is being worn, wherein a curvature inward of the channel portion toward the channel when the holster is being worn determines the user force needed to remove the gun from the holster, the curvature forming the first part of the gun lock mechanism, the second part of the gun-lock mechanism including an integrally formed wedge shaped retention structure having a first portion end toward the open top, the first portion end extending to a second portion end toward the open bottom, wherein the wedge is wider at the second portion end and the second portion end adjoins a projection formed to accept a trigger guard;

wherein the gun-lock mechanism includes a twist-release and is configured to:

allow a trigger guard, when being holstered, to slide over the first portion end, allow a user to guide the trigger guard along the wedge shaped portion, past the second portion end, house the trigger guard in the projection and retain the trigger guard under a positive retention in the gun-lock region, allow a user to release the trigger guard with a slight twisting of the handgun, allow a user to unlock the handgun with the twisting motion, allow a user to urge the trigger guard upwards along the wedge shaped portion, release the positive retention force, enabling a smooth draw and one-banded retraction of the handgun from the holster.

2. The holster according to claim 1, wherein the clip is variably positionable in an angle alpha chosen from 0 to 30 degrees.

3. The holster according to claim 2, including a stop for restraining rotation of the clip about the axis at variable selected positions amid at least the 0 to 30 degrees.

4. The holster according to claim 1, wherein the gun-lock region forms a positive retention on the handgun within the holster until the trigger guard releases past the second portion end.

5. The holster according to claim 4, wherein the first portion end does not extend into the channel as far as the second portion end.

6. The holster according to claim 5, wherein the mold progresses inwardly at the first portion end in a sloped manner toward the second portion end, and the second portion end adjoins the projection at an at least 80 degree angle.

7. The holster according to claim 6, wherein where the second portion end adjoins the projection, the projection turns outwardly away from the channel at an angle between 80 degrees and 90 degrees.

8. The holster according to claim 7, wherein the rigid mold includes a polymer portion.

9. The holster according to claim 1, wherein the gun-lock region is configured to generate a force sufficient to retain the handgun when the holster is positioned on a wearer's beltline and, wherein the gun-lock region does not generate a force sufficient to retain the handgun when not on a wearer's beltline.

10. A handgun holster for carrying a handgun inside a wearer's beltline, said holster comprising:

(a) a body-interface-surface (BIS) having a body-side (BS) layer and a gun-side (GS) layer, wherein the BIS has a surface area larger than the side profile of the handgun when holstered to form a barrier between the entirety of the holstered handgun and the wearer, (b) a rigid mold attached to the gun-side of the BIS and defining a channel for receiving the handgun, the interface between the rigid mold and the GS layer of the BIS forming a gun-lock region;

(c) the gun-lock region including a two-part gun lock mechanism;

the first part of the gun-lock mechanism including a channel portion spanning from a right side interface between the BIS and the mold and a left side interface between the BIS and the mold, the channel portion configured to secure the gun in the holster until acted upon by a user force when the holster is being worn due to an inward curvature of the channel portion, the second part of the gun-lock mechanism including an integrally formed wedge shaped retention structure having a first portion end and a second portion end, (d) a compression layer between the body-side and the gun-side of the BIS, and (e) at least one pivotally supported clip, pivotal about an axis that passes perpendicularly through the mold, and the clip attached on a portion of the rigid mold that protrudes further outwardly from an outside surface plane of the rigid mold, the portion located near the bottom surface of the rigid mold and remaining in the bottom third of the mold.

11. The holster according to claim 10, wherein the BIS has a flexibility sufficient to mold to the wearer's body.

12. The holster according to claim 11, wherein the BS-layer has a thickness of about 0.5 to about 3.0 mm, the GS-layer has a thickness of 0.5 to 3.0 mm, and the compression layer has a thickness of 0.5 to 3.0 mm.

13. The holster according to claim 12, wherein the compression layer includes neoprene.

14. The holster according to claim 13, wherein the compression layer has a compression sufficient to contribute to the purchase of the handgun.

15. The holster according to claim 10, wherein the gun-side layer, body-side layer and compression layer extend substantially parallel to each other within the BIS.

16. The holster according to claim 15, including attachment points for attachment of the mold to the BIS, wherein the attachment points do not extend all the way through the BIS.

17. The holster according to claim 16 wherein the attachment points terminate inside the BIS and the BS layer of the BIS is an uninterrupted layer.

* * * * *